United States Patent [19]

Forster

[11] Patent Number: 4,893,549

[45] Date of Patent: Jan. 16, 1990

[54] ADJUSTABLE AXIAL PISTON MACHINE HAVING A BENT AXIS DESIGN

[75] Inventor: Franz Forster, Karlstadt/Main-Muhlbach, Fed. Rep. of Germany

[73] Assignee: Linde Aktiengelsellschaft, Wiesbaden, Fed. Rep. of Germany

[21] Appl. No.: 225,284

[22] Filed: Jul. 28, 1988

[30] Foreign Application Priority Data

Jul. 31, 1987 [DE] Fed. Rep. of Germany ..... 3725525

[51] Int. Cl.[4] ..... F01B 3/00; F01B 13/04

[52] U.S. Cl. ..... 92/12.2; 91/506

[58] Field of Search ..... 92/12.1, 12.2; 91/506, 91/486, 487; 417/222

[56] References Cited

U.S. PATENT DOCUMENTS

| | | | |
|---|---|---|---|
| 3,303,794 | 2/1967 | Hagemann | 91/506 X |
| 3,779,137 | 12/1973 | Koivunen | 91/506 X |
| 3,958,496 | 5/1976 | Wallin | 91/506 |
| 4,129,063 | 12/1978 | Ifield | 91/506 |
| 4,382,399 | 5/1983 | Lotter | 91/486 |
| 4,444,092 | 4/1984 | Schott | 91/486 |
| 4,449,444 | 5/1984 | Forster | 417/222 X |

FOREIGN PATENT DOCUMENTS

| | | | |
|---|---|---|---|
| 687055 | 5/1964 | Canada | 91/506 |

*Primary Examiner*—Robert E. Garrett
*Assistant Examiner*—Mark A. Williamson
*Attorney, Agent, or Firm*—Webb, Burden, Ziesenheim & Webb

[57] ABSTRACT

An adjustable axial piston machine having a bent axis design having a cylindrical drum rotatably supported on a swivel carriage which has a pair of channels formed therein. One channel is connected with a fluid feed channel and the other channel is connected with a fluid discharge channel. The cylindrical drum is connected to a rotatable shaft and has a plurality of pistons located in cylinders formed in it. A housing for the swivel carriage has a concave guide surface for the face of the swivel carriage facing the guide surface. Support pistons are pivotably connected at one end to the machine housing and supported on the swivel carriage. A plurality of pairs of counteracting servo pistons adjust the position of the support pistons and the cylindrical drum to modify the length of the stroke of the pistons located within the drum.

10 Claims, 4 Drawing Sheets

ADJUSTABLE AXIAL PISTON MACHINE HAVING A BENT AXIS DESIGN

BACKGROUND OF THE INVENTION

1. Field of the Invention

The invention relates generally to an adjustable axial piston machine with a bent axis design and more particularly to such a machine having a rotatable cylindrical drum with a plurality of cylindrical bores formed therein and a piston located in each bore. One end of the cylindrical drum is mounted on a shaft and the other end is supported on a swivel carriage. The swivel carriage has a pair of channels formed therein one of which is connected with a fluid supply channel and the other of which is connected with a fluid discharge channel. The swivel carriage is supported by at least one piston against a guide surface formed on the machine swivel carriage housing so that the cylindrical drum and the support piston or pistons carrying the swivel carriage are movable in the same direction. The cylindrical drum has openings in one end face connected with cylindrical boreholes formed in the swivel carriage and is rotatable relative to the swivel carriage. Servo pistons are provided for adjusting the angle between the axis of the cylindrical drum and the guide surface on the machine swivel carriage housing to change the length of the stroke of the pistons in the cylindrical bores in the cylindrical drum.

2. Description of the Prior Art

In known adjustable axial piston machines of this type, the swivel carriage is hydrostatically relieved with respect to the swivel carriage guide surface for easy adjustability. In order that the release does not increase with increased adjustment of the swivel carriage angle and thereby form a gap resulting in leakage losses the fluid feed and fluid discharge channels on the side of the swivel carriage facing the swivel carriage guide surface are formed to be increasingly more narrow. Due to the limited channel cross section a high flow rate of the fluid occurs with large adjustment angles resulting in the loss of hydraulic fluid.

Additionally, the adjustment of the angle between the cylindrical drum axis and the guide surface in the prior art machines, i.e., the adjustment of the piston stroke and thus the power, is by a servo-operated piston that is located in a control head on the outside of the swivel carriage guide housing since the servo piston is connected with the swivel carriage. When large adjustment angles are required, a long servo piston stroke is required and a large control head is necessary to house the servo piston which results in undesirable increased machine dimensions.

SUMMARY OF THE INVENTION

The invention is an adjustable axial piston machine having a bent axis design which is capable of achieving a large adjustment angle with low fluid losses and is capable of increased power output. A machine according to the invention includes at least one support piston connected to the swivel carriage having a piston rod articulately connected to the housing.

A force acting against hydrostatic release of the swivel carriage is applied to the swivel carriage by the support piston which means that large fluid feed and discharge channels may be utilized. Since the flow rate of the fluid is not increased by decreasing the size of the channels with a large piston stroke hydraulic losses are minimized.

A particularly advantageous embodiment of the axial piston machine of the invention includes support pistons having one end located in a cylindrical bore in the flat surface of the swivel carriage. The support pistons have longitudinal passages extending therethrough which are connected with the fluid feed channel or fluid discharge channel in the swivel carriage. The cylindrical bore for receiving the support piston on the side of the swivel carriage on which fluid feed takes place is connected with the fluid feed channel, and the cylindrical bore for receiving the support piston on the side of the swivel carriage on which fluid discharge takes place is connected with the fluid discharge channel. The swivel carriage is thus loaded with the fluid pressure prevailing in the corresponding channel and is pressed against the swivel carriage guide surface so that leakage losses between the swivel carriage and the swivel carriage guide surface are minimized.

In another embodiment of the invention, hydraulically actuated and controlled servo pistons are articulately connected to the piston rod of each support piston. Each connection is located about midway of the length of the piston rod of each support piston in planes that are perpendicular to the axis of curvature of the swivel carriage and the swivel carriage guide surface to facilitate motion of the convex swivel carriage along the concave swivel carriage guide surface. The overall swivel carriage adjusting device consisting of support pistons and their rods and servo pistons and their rods is located inside of the swivel carriage housing so that the machine is compact and a control head on the outside of the swivel carriage housing is unnecessary.

It is particularly advantageous to employ two counter-acting servo pistons opposite each other. These servo pistons lie in the same plane perpendicular to the axis of curvature of the swivel carriage and the swivel carriage guide surface. This arrangement saves space compared with the use of a single double-acting cylinder servo piston because the two small servo pistons can be installed completely inside of the swivel carriage housing.

If the free ends of the piston rods of the servo pistons are spherical and engage sockets on the support pistons, a rotary movement of a servo piston inside of its cylinder relative to the cylinder axis occurs so that the piston rods and pistons are free of transverse forces which results in reduced wear on the piston and the inner wall of the cylinder.

In another embodiment of the invention, the support pistons and their piston rods have longitudinal passages for the flow of fluid. This results in the additional advantage that no fluid feed and discharge channels are required in the swivel carriage guide surface, and therefore the housing is more compact.

In a further embodiment of the invention, two support pistons have a common piston rod. The swivel carriage is therefore pressed more uniformly against the swivel carriage guide surface at all four corners, and fluid leakage losses are further reduced. It is also possible to increase the number of support pistons having a common piston rod.

The invention is explained in further detail hereinafter with reference to the drawings wherein like reference numerals refer to like parts throughout.

DESCRIPTION OF THE PREFERRED EMBODIMENTS

Figure 1:
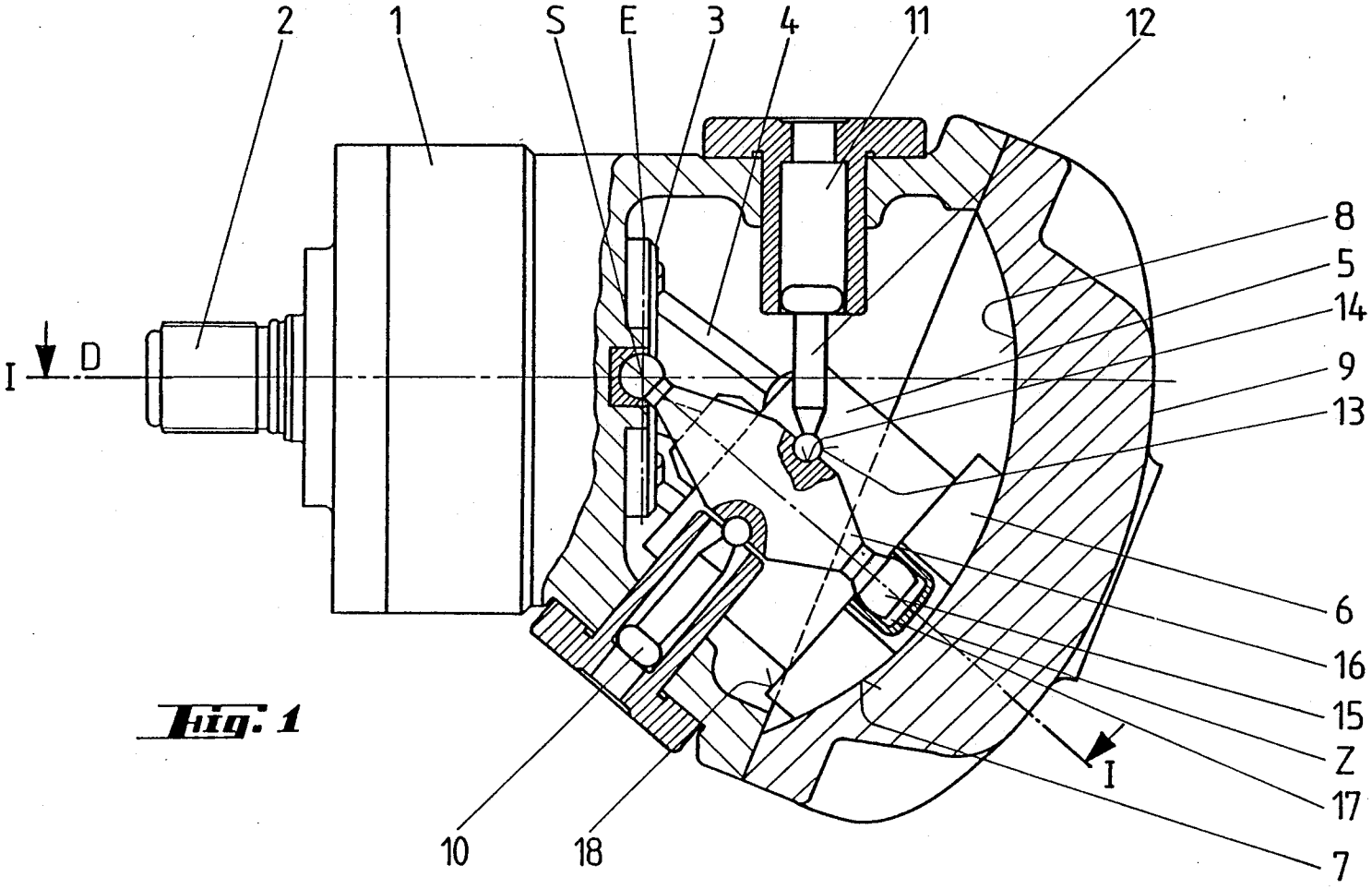
FIG. 1 is a partial longitudinal section of an axial piston machine according to the invention.

FIG. 1 of the drawings shows an adjustable axial piston machine having a bent axis design according to the invention. A rotary shaft 2 which may be either a drive shaft or a driven shaft has an axis of rotation D and is supported on standard bearings (not shown) inside of machine housing 1. A piston guide member has a surface 3 located inside of the machine housing 1 at the inner end of shaft 2 and is perpendicular to the axis of rotation D. A plurality of piston rods 4 of reciprocable pistons (not shown) are located in cylindrical bores (not shown) inside of a rotary cylindrical drum 5. The free ends of piston rods 4 are supported in a plane E at the piston guide member surface 3. The rotatable cylindrical drum 5 is supported on a nonrotatable swivel carriage 6 on its axis of rotation Z. The swivel carriage 6 has a convex end face 7 positioned against the concave swivel carriage guide surface 8 of swivel carriage housing 9 which is attached to the machine housing 1 by a flange connection. The cylindrical drum 5 is pivotable relative to its axis of rotation Z about a point S located on the plane E on the axis of rotation D of the machine. The point S is defined as the point of intersection of the axis of rotation D of the machine and the axis of rotation Z of the cylindrical drum. The angle between the two axes of rotation is designated as the pivot angle, and the stroke length of the pistons in cylindrical drum 5 is modified by changing the pivot angle.

In the position shown in FIG. 1 of the drawings, the cylindrical drum 5 is located at the maximum pivoting angle wherein the maximum stroke of the pistons inside of the cylindrical drum is obtained. With a synchronous rotary movement of the shaft 2 and the cylindrical drum 5 in the same direction, the maximum possible flow volume of fluid is obtained inside of the machine which results in the maximum power output. With a zero degree pivot angle no fluid is delivered and thus there is no power output. If the cylindrical drum 5 is pivoted past the zero degree position in a different machine model (not shown), the direction of rotation of the cylindrical drum and the drive shaft or driven shaft is modified, depending on which side the energy feed, i.e., the rotational movement, occurs, that is, as a function of the operation of the machine as either a pump or a motor.

The position of the cylindrical drum 5 is adjusted with respect to the axis of rotation D of the machine, i.e., the adjustment of the pivot angle, through the hydraulically or pneumatically actuated counteracting servo pistons 10 in single-acting operating cylinders 11 which are located inside of machine housing. The resetting of a servo piston 10 in its operating cylinder 11 is accomplished by the movement of the opposite servo piston 10 in the opposite operating cylinder 11. The counteracting servo pistons thus act in pairs and in the opposite direction in this embodiment of the invention. A rigid piston rod 12 is attached to each servo piston 10, and the free end of each piston rod 12 has a spherical head or ball 13. Each head 13 is supported in a socket 14 which is formed in a piston rod 16 for a support piston 15. There are at least two support pistons 15 and each of them has a spherical end located in a borehole 17 on the substantially flat side 18 of swivel carriage 6. The free end of each piston rod 16 is supported by a ball head in a socket in machine housing 1. The axes of piston rods 16 of support pistons 15 are parallel with the axis of rotation Z of cylindrical drum 5 and are located in a common plane with the axis of rotation Z. The plane is perpendicular to the pivoting direction of swivel carriage 6. When opposite counteracting servo pistons 10 are moved in or out of their cylinders 11 the swivel carriage 6, guided by convex end face 7 in concave swivel carriage guide surface 8, is pivoted around the point S relative to the piston member guide surface 3 with a support piston 15 and a piston rod 16 connected to it. Because each servo piston rod connection 13 and 14 is a ball and socket joint a pivoting movement of servo pistons 10 inside of operating cylinders 11 occurs so that the servo pistons 10 should have a spherical shape of the generated surface. The piston rods 12 of servo pistons 10 thus remain free of transverse forces thereby minimizing wear between the servo pistons 10 and the inner surface of the operating cylinders 11. The use of counteracting servo pistons 10 and operating cylinders 11 as small adjusting units results in a compact arrangement which is capable of obtaining large pivot angles.

As an alternative to the ball and socket connections between the end of the servo piston rods 12 and the piston rod 16, it is possible to use an arrangement (not shown) wherein the free ends of the piston rods 12 have a spherical shape and are in contact with the exterior surface of the piston rods 16 of the support pistons 15. Movement of the servo pistons 10 produces a relative movement between the free ends of their piston rods 12, and as a result, the support piston 15 pivots around the point S. However, in this arrangement, the friction forces at the contact points between the piston rods 12 and piston rod 16 create transverse forces which result in wear between the pistons 10 and their cylinders.

Figure 3:
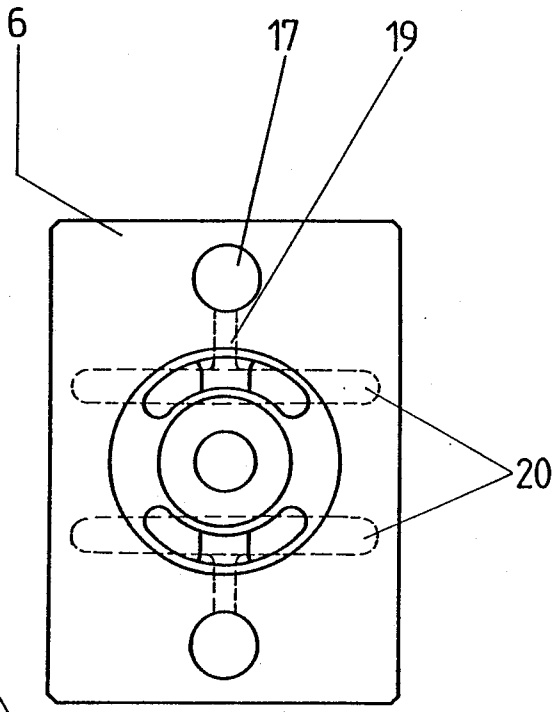
FIG. 3 is a section on line II—II of FIG. 2.
Figure 2:
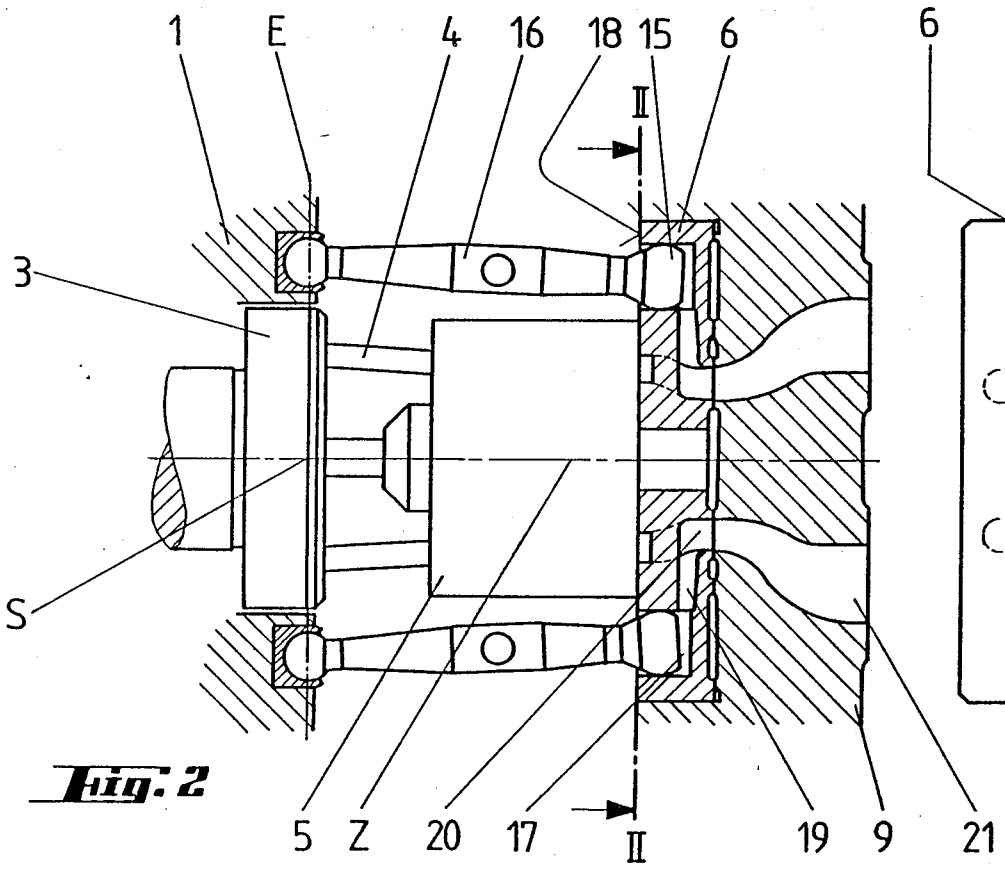
FIG. 2 is a partial section on line I—I of FIG. 1.

FIGS. 2 and 3 of the drawings show the arrangement of the fluid feed and discharge channels. The boreholes 17 in swivel carriage 6 are connected with fluid feed or fluid discharge channels 20 through channels 19 which are also formed in swivel carriage 6. In this arrangement, the pressure prevailing in the boreholes acts on support pistons 15 to press the swivel carriage 6 against the swivel carriage guide surface 8 of swivel carriage housing 9 by a force which acts against the hydrostatic release forces. Therefore, it is not necessary to make the fluid feed and discharge channels 20 narrower as the pivot angle increases in order to reduce the hydrostatic release forces and no additional flow losses occur. Additionally, the power of a machine designed in this manner is increased relative to the power of machines according to the known state of the art. The additional contact pressure produced by the support pistons increases and decreases with rising and falling fluid pressure inside of the channels, i.e., it automatically adapts to the prevailing pressure conditions.

Since the adjusting units for regulating the position of the swivel carriage 6 are inside of machine housing 1 the fluid feed and drain channels 20 in the swivel carriage 6 and their continuations 21 in the swivel carriage housing 9 can be made larger. This is possible because more space is available between the channels due to the absence of the usually large operating cylinder in the swivel carriage housing 9.

Figure 5:
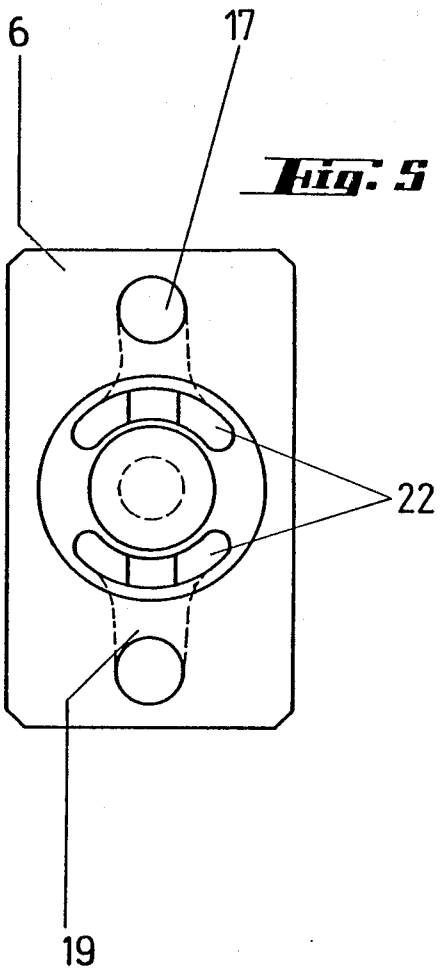
FIG. 5 is a section on line III—III of FIG. 4.
Figure 4:
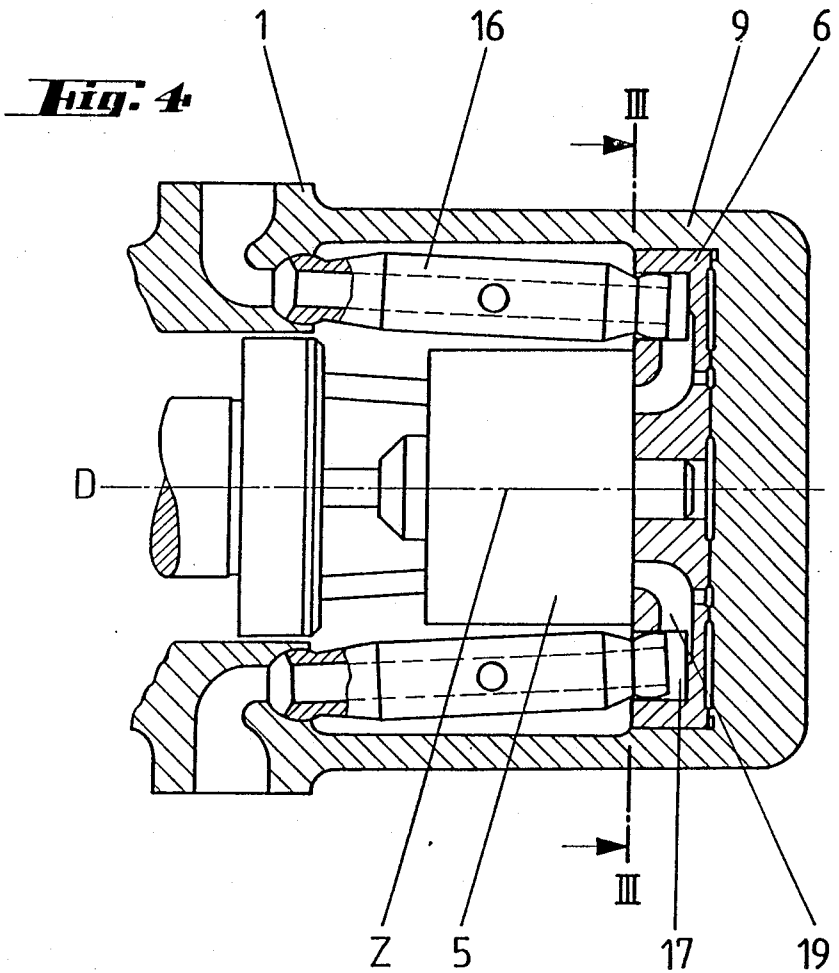
FIG. 4 is a partial section similar to FIG. 2 of a second embodiment of the invention.

Another embodiment of the invention is shown in FIGS. 4 and 5 of the drawings. In this embodiment the piston rods 16 of support pistons 15, the support pistons 15 and the spherical heads or balls are hollow so that fluid feed or fluid discharge does not take place through channels in the swivel carriage housing 9 but rather through the pistons and the channels 19 which connect cylindrical boreholes 17 with control slots 22. In this arrangement, the walls of swivel carriage housing 9 can be thinner which results in a more compact machine than the machine shown in FIGS. 1 and 2 of the drawings.

Figure 7:
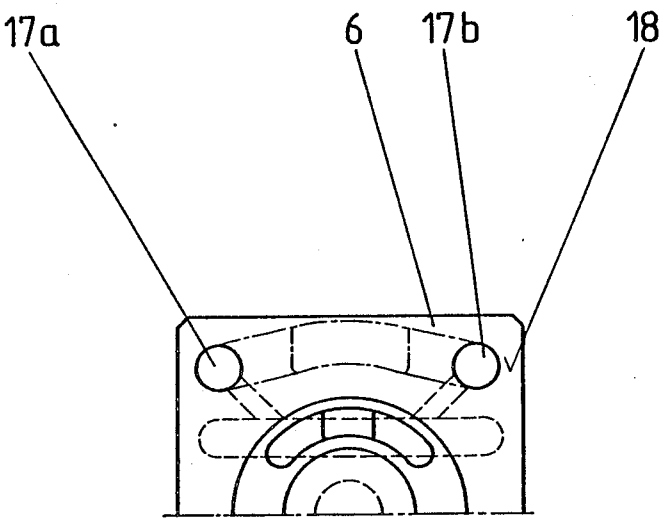
FIG. 7 is a partial plan view of a swivel carriage for use with the embodiment of FIG. 6.
Figure 6:
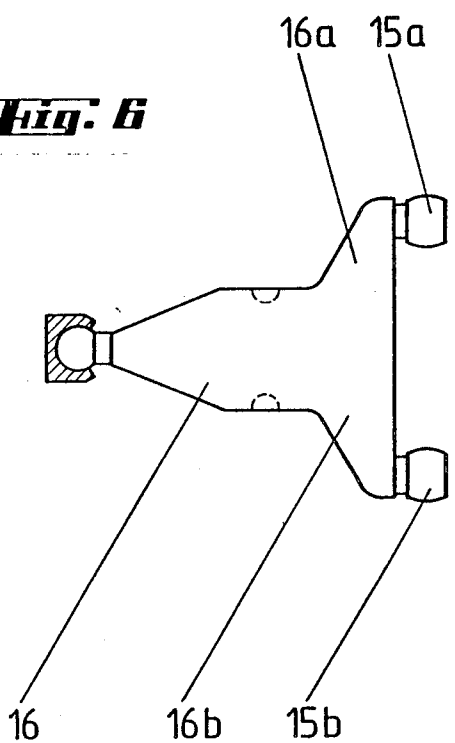
FIG. 6 is a plan view of another embodiment of the invention wherein the piston rod has two support pistons.

FIGS. 6 and 7 show another embodiment of the invention wherein the piston rod 16 has two webs 16*a* and 16*b* on its free end and support pistons 15*a* and 15*b* are located on the webs. The support pistons lie in a plane that is perpendicular to the plane including the piston rods 16 and the axis of rotation Z of cylindrical drum 5. The boreholes 17*a* and 17*b* on the swivel carriage 6 are located in the corners of the substantially flat side 18 of swivel carriage 6. In this arrangement, the swivel carriage 6 is more uniformly pressed against the swivel carriage guide surface 8 of swivel carriage housing 9 at its four corners although only two piston rods 16 are required for adjusting the pivoting angle.

While preferred embodiments of the invention have been shown and described herein, it is to be understood that the invention may be embodied within the scope of the appended claims.

What is claimed:

1. An adjustable axial piston machine having a bent axis design including a machine housing, a rotatable shaft, a swivel carriage having opposed-faces and a pair of channels formed therein and a cylindrical drum having a first end rotatably supported on said swivel carriage and a second end, one of said channels in said swivel carriage being connected with a fluid feed channel and the other of said channels in said swivel carriage being connected with a fluid discharge channel, means for supporting said second end of said cylindrical drum on said rotatable shaft at a piston guide member surface, said cylindrical drum and said rotatable shaft being rotatable in the same direction, said cylindrical drum having a plurality of cylindrical bores formed therein and a reciprocable piston located in each of said cylindrical bores in said cylindrical drum, a swivel carriage housing connected to said machine housing forming a concave swivel carriage guide surface, the face of said swivel carriage opposite said cylindrical drum being convex and positioned against said concave guide surface of said swivel carriage housing, the common axis of curvature of the convex face of said swivel carriage and the concave swivel carriage guide surface of said swivel carriage housing intersects the axis of rotation of said cylindrical drum in said piston guide member surface, a plurality of pairs of counteracting servo piston means for adjusting the angle between the axis of rotation of said cylindrical drum and the piston guide surface to modify the length of the stroke of said pistons within said bores in said cylindrical drum, and at least one support piston having a piston rod pivotably connected to said machine housing and an end connected to said swivel carriage, whereby reciprocation of said serve piston means adjusts the location of said swivel carriage in said swivel carriage housing.

2. An axial piston machine as set forth in claim 1 wherein said swivel carriage has at least one cylindrical bore for receiving the end of said at least one support piston, said cylindrical bore of said swivel carriage being connected with said fluid feed channel or said fluid drain channel.

3. An axial piston machine set forth in claim 2 wherein each of said servo piston means includes a hydraulically actuatable piston rod and the free end of each servo piston rod is articulately connected to the piston rod of said at least one support piston.

4. An axial piston machine as set forth in claim 3 wherein said servo piston means is two counteracting servo pistons positioned opposite each other and having a piston rod, and each piston rod of said servo piston means is articulately attached to the piston rod of a support piston to adjust the position of said at least one support piston.

5. An axial piston machine as set forth in claim 4 wherein at least one support piston and said piston rods and balls thereon are hollow for passing fluid therethrough.

6. An axial piston machine as set forth in claim 5 wherein a plurality of support pistons are carried on a common piston rod.

7. An axial piston machine as set forth in claim 4 wherein each piston rod of said servo piston means includes a free end and said free end of each of said piston rods of each of said servo piston means is a ball and socket means formed on said piston rod of said at least one support piston to receive said ball to move said support piston.

8. An axial piston machine as set forth in claim 7 wherein said at least one support piston and said piston rod and balls thereon are hollow for passing fluid through.

9. An axial piston machine as set forth in claim 7 wherein a plurality of support pistons are carried on a common piston rod.

10. An axial piston machine as set forth in claim 4 wherein a plurality of support pistons are carried on a common piston rod.

* * * * *

UNITED STATES PATENT AND TRADEMARK OFFICE

CERTIFICATE OF CORRECTION

PATENT NO. : 4,893,549

DATED : January 16, 1990

INVENTOR(S) : Franz Forster

It is certified that error appears in the above-identified patent and that said Letters Patent is hereby corrected as shown below:

Column 3 Line 67 after "housing" insert --1--.

Claim 1 Line 13 Column 6 "serve" should read --servo--.

Claim 10 Line 55 Column 6 "4" should read --5--.

Signed and Sealed this

Seventh Day of August, 1990

*Attest:*

HARRY F. MANBECK, JR.

*Attesting Officer*

*Commissioner of Patents and Trademarks*